US008567832B2

(12) United States Patent
Kannaka

(10) Patent No.: US 8,567,832 B2
(45) Date of Patent: Oct. 29, 2013

(54) HAND GRIP FOR ELECTRONIC DEVICES

(76) Inventor: Robert E. Kannaka, Lakewood, CO (US)

( * ) Notice: Subject to any disclaimer, the term of this patent is extended or adjusted under 35 U.S.C. 154(b) by 0 days.

(21) Appl. No.: 13/350,088

(22) Filed: Jan. 13, 2012

(65) Prior Publication Data

US 2012/0187706 A1 Jul. 26, 2012

Related U.S. Application Data

(60) Provisional application No. 61/461,724, filed on Jan. 24, 2011.

(51) Int. Cl.
*B65G 7/12* (2006.01)

(52) U.S. Cl.
USPC ..... 294/25; 224/218; 224/930

(58) Field of Classification Search
USPC ..... 294/25, 137, 142; 361/814; 455/575.1, 455/575.6, 575.8; D14/137, 138 R; 150/154, 156; 224/217, 218, 930; 206/320; 24/300, 301, 302, 458, 24/265 BC, 182
See application file for complete search history.

(56) References Cited

U.S. PATENT DOCUMENTS

| | | | | |
|---|---|---|---|---|
| 2,283,988 | A * | 5/1942 | Heath | 401/6 |
| 6,266,685 | B1 * | 7/2001 | Danielson et al. | 708/141 |
| 6,724,618 | B1 * | 4/2004 | Jenkins et al. | 361/679.32 |
| D633,504 | S | 3/2011 | Alexander, Jr. | |
| D642,579 | S | 8/2011 | Deutsch et al. | |
| 2004/0013279 | A1 * | 1/2004 | Takeda | 381/312 |
| 2005/0205623 | A1 | 9/2005 | Buntain | |
| 2006/0054704 | A1 | 3/2006 | Fitch et al. | |
| 2008/0083797 | A1 | 4/2008 | Myers | |
| 2008/0203127 | A1 * | 8/2008 | Castillo-Garrison | 224/607 |
| 2009/0009945 | A1 | 1/2009 | Johnson et al. | |
| 2009/0321483 | A1 | 12/2009 | Froloff | |
| 2010/0116387 | A1 * | 5/2010 | Channey et al. | 150/165 |
| 2012/0063066 | A1 * | 3/2012 | Floit | 361/679.01 |

OTHER PUBLICATIONS www.lazy-hands.com; Thumbs Free Grips for Mobile Devices; Jan. 11, 2012.

* cited by examiner

*Primary Examiner* — Stephen Vu
(74) *Attorney, Agent, or Firm* — Mark D. Trenner; Trenner Law Firm

(57) ABSTRACT

A hand grip for an electronic device is disclosed. An example hand grip may include a backing removably attachable to a back side of the electronic device by stretching over opposite edge portions of the electronic device. The hand grip may also include a handle member connecting with the backing. The handle member connects with one or more finger of a user to securely hold the handheld electronic device by the hand of the user.

5 Claims, 9 Drawing Sheets

HAND GRIP FOR ELECTRONIC DEVICES

PRIORITY CLAIM

This application claims priority to U.S. Provisional Patent Application No. 61/461,724 filed on Jan. 24, 2011 for "Kanna-Grip" of Robert E. Kannaka, incorporated herein by reference as though fully set forth herein.

BACKGROUND

With the ever increasing popularity of mobile or handheld electronic devices, such as smart phones and tablets (and proprietary brands such as Apple's iPhone™ and iPad™), the market continues to grow for accessories for these devices. Accessories include a variety of covers, including screen protectors, cases, and even so-called "skins" that allow the user to quickly and easily change the color of the device case. While some of these serve only an aesthetic purpose (e.g., the skins), others of these serve a protective function. For example, the cases protect the device from some bumps and even short drops. But none of these cases provide the user with a better grip to reduce or altogether prevent dropping of the device.

BRIEF DESCRIPTION OF THE DRAWINGS

FIG. 1 shows multiple views of an example handheld electronic device which the hand grip described herein may be used with.

DETAILED DESCRIPTION

While there are many cases available as accessories for mobile or handheld electronic devices, none of these cases provide the user with a better grip to reduce or altogether prevent dropping of the device. The hand grip disclosed herein enables the user to better grip mobile or handheld electronic devices, such as but not limited to, smart phones and tablets (and proprietary brands such as Apple's iPhone™ and iPad™, Androids™, and others). For example, the hand grip enables the user to manipulate the phone using only one hand (and in some examples, a single finger), and reduces dropping the phone. Various embodiments are disclosed which provide a comfortable and supportive backing and help to ensure proper handling of the electronic device in the user's fingers and/or hand. The handles or straps also offer people the option to "hang" or secure their phone around their wrist, purse strap, backpack, etc. These and other features and advantages of the hand grip will become readily apparent after becoming familiar with the teachings herein.

Before continuing, it is noted that as used herein, the terms "includes" and "including" mean, but is not limited to, "includes" or "including" and "includes at least" or "including at least." The term "based on" means "based on" and "based at least in part on."

Figure 1:
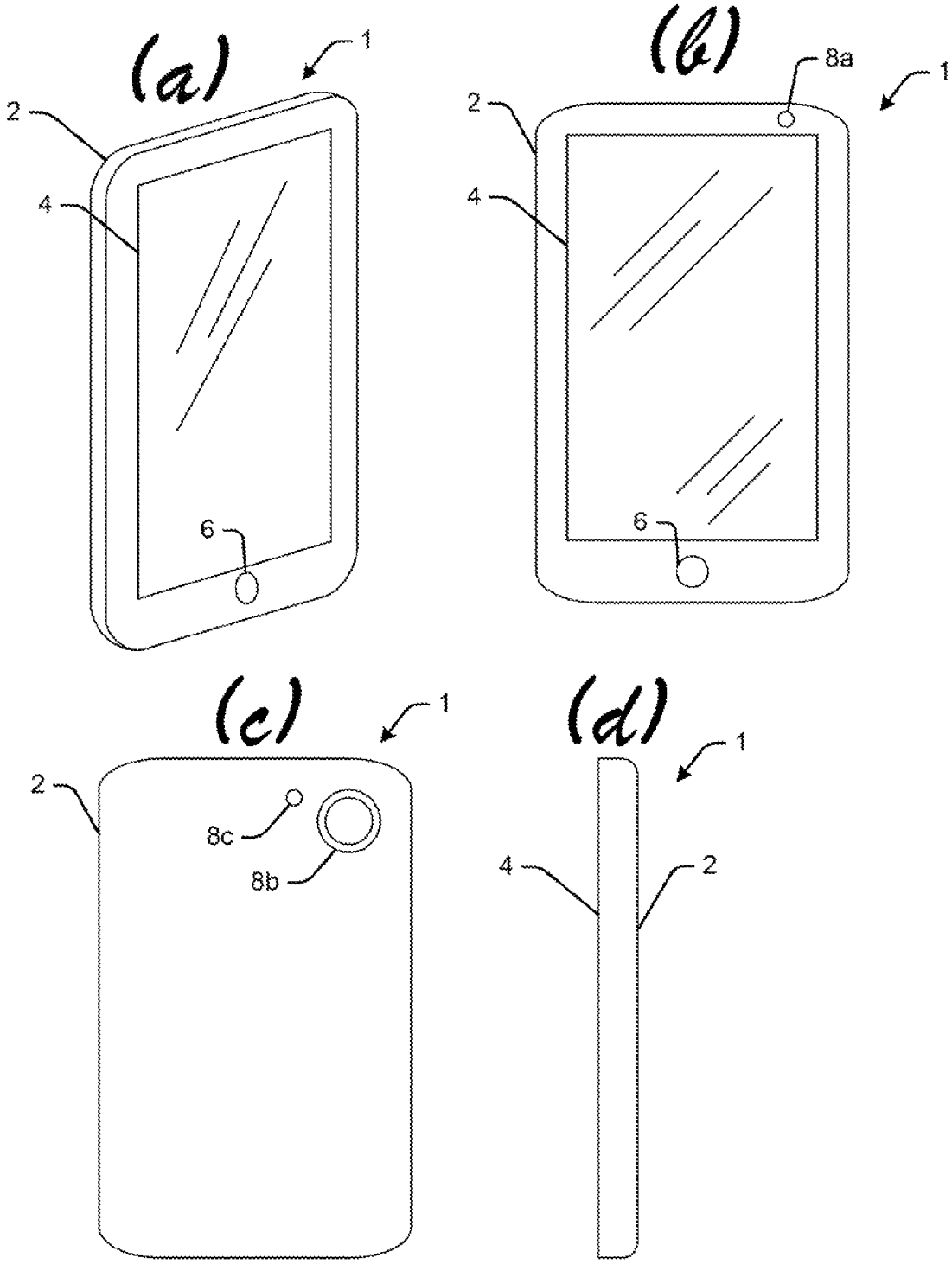
Fig. 1 PRIOR ART

FIG. 1 shows multiple views of an example handheld electronic device 1. In FIG. 1, the view labeled (a) is a perspective view of the electronic device 10, (b) is a front plan view of the electronic device, (c) is a back plan view of the electronic device, and (d) is a side plan view of the electronic device.

The electronic device 1 may include a housing 2 for internal electronic components (not shown), and a display 4 that a user may operate for interfacing with the electronic device 1. For example, the display 4 may be a touch-sensitive screen which both receives user input and displays output for a user. Some electronic devices 1 include one or more buttons 6 that the user may operate in addition to (or in place of) a touch-sensitive screen. While only one button 6 is shown in FIG. 1, it is understood that multiple buttons (or no buttons at all) may be provided. The electronic device 1 may also include ports (not shown), such as USB, video, and/or charging ports. The electronic device 1 may also include a camera lens (such as front-facing camera lens 8*a* and/or rear-facing camera lens 8*b* and associated flash 8*c*).

The electronic device 1 may be, but is not limited to, a smart phone or tablet (and proprietary brands such as Apple's iPhone™ and iPad™), gaming devices, controllers (e.g., remote controls), and other like devices. Therefore, the figure is labeled as "Prior Art" and is shown for the purpose of illustrating one example of an electronic device described herein may be used with. The hand grip itself is not shown in FIG. 1, and therefore the label "Prior Art" is not to be construed as an admission that any part of the hand grip is known.

Of course, it will be readily appreciated that the hand grip described herein may be suitably modified to work with any of a wide variety of different sizes and shapes of electronic devices, now known in the market and those later developed and introduced, without departing from the teachings herein.

Before continuing, it should be noted that the examples described above are provided for purposes of illustration, and are not intended to be limiting. Other devices and/or device configurations may be utilized to carry out the operations described herein.

Figure 2:
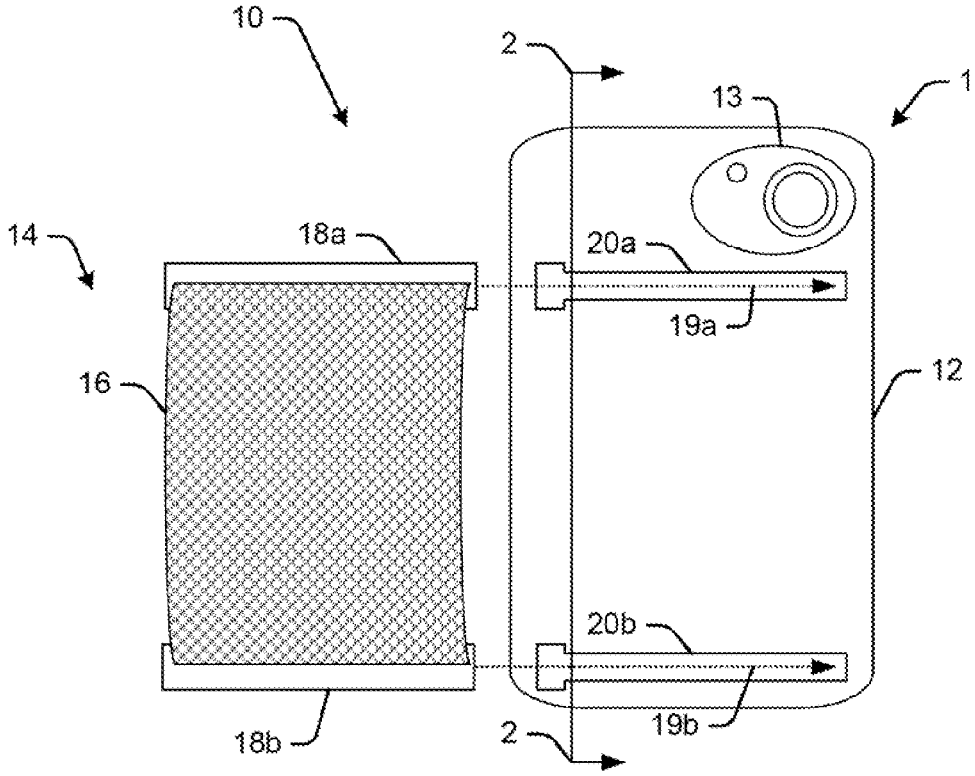
FIG. 2 shows an example hand grip as it may be connected to the handheld electronic device.
Figure 2A:
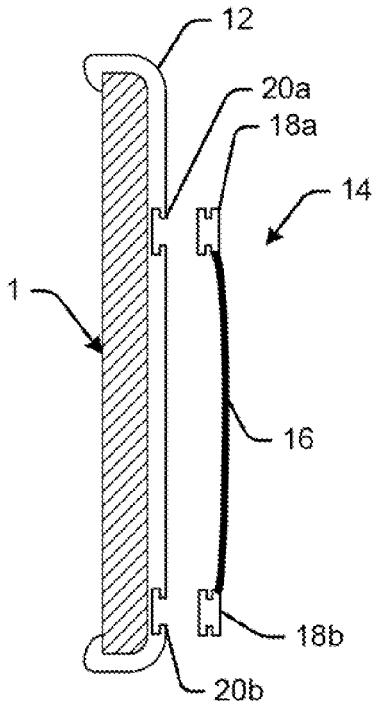
FIG. 2*a* is a cutaway side view of the hand grip attached to the handheld electronic device taken along lines 2-2 shown in FIG. 2.

FIG. 2 shows an example hand grip 10 as it may be connected to the handheld electronic device 1. FIG. 2*a* is a cutaway side view of the hand grip 10 attached to the handheld electronic device 1 taken along lines 2-2 shown in FIG. 2.

In the example shown in FIG. 2, the hand grip 10 may include a backing 12 removably attachable to a back side of the electronic device 1 by stretching over opposite edge portions (e.g., around the perimeter) of the electronic device. A cutout 13 can be provided in the backing 12, e.g., for camera lens, flash, and/or ports. The hand grip 10 may also include a handle member 14 connecting with the backing 12. The handle member connects with one or more finger of a user to securely hold the electronic device 1 by the hand of the user. For example, the user may slide his or her fingers between the backing 12 on the electronic device 1 and the handle 14.

The backing 12 may be made of any suitable material that substantially conforms to the shape of the electronic device 1, but can be stretched around at least a portion of the perimeter of the electronic device 1, similar to attaching a conventional silicon cover to a mobile phone device. The backing 12 may be made of silicon or any other material that provides the function described herein. The backing 12 may have a composition with any degree of flexibility or rigidity, depending at least in part on the desired function.

In the example shown in FIG. 2, the handle member 14 includes a strap 16. Strap 16 may be made of a mesh, elastic, leather, cotton/blend, or any such desired material (including fashion straps), any colors, styles of straps (e.g., based on fabric type), and designs on the straps. As such, the strap is sufficiently resilient to lay substantially flat against the back side of the electronic device when not in use, but can be readily pulled out from the back side of the electronic device 1 for grasping and positioning the user's fingers between the strap 16 and the back of the electronic device 1.

The handle member 14 may be attached to the electronic device 1 via an insert 18*a-b* on each end of the strap 16. The inserts 18*a-b* can be slid (e.g., as illustrated by arrows 19*a-b*) into elongated notches 20*a-b* formed inside opposite end portions of the backing 12. Accordingly, the inserts 18*a-b* engage inside the respective elongated notches 20*a-b* to attach the handle member 14 to the backing 12.

The handle member 14 may be attached to the backing 12 before and/or after attaching the backing 12 to the electronic device 1. For example, the user may replace the handle member 14 if the handle member becomes stretched or worn out, without having to replace the backing 12.

Other embodiments are also contemplated, as illustrated for purposes of example in the drawings described as follows. It is noted that various embodiments use like reference numbers to refer to like components in the drawings, but different embodiment are distinguished by different hundred series reference numbers (e.g., 110, 210, etc.). Therefore, each component may not be described again separately for each embodiment, except to the extent variations are present.

Figure 3:
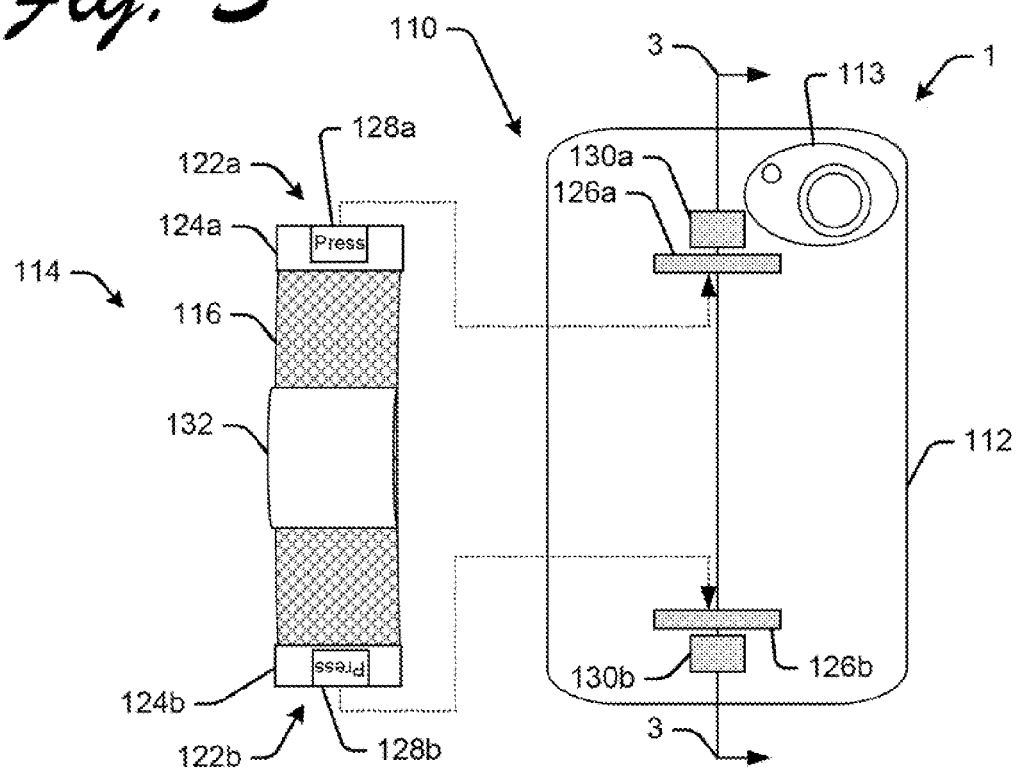
FIG. 3 shows an example hand grip as it may be connected to the handheld electronic device.
Figure 3A:
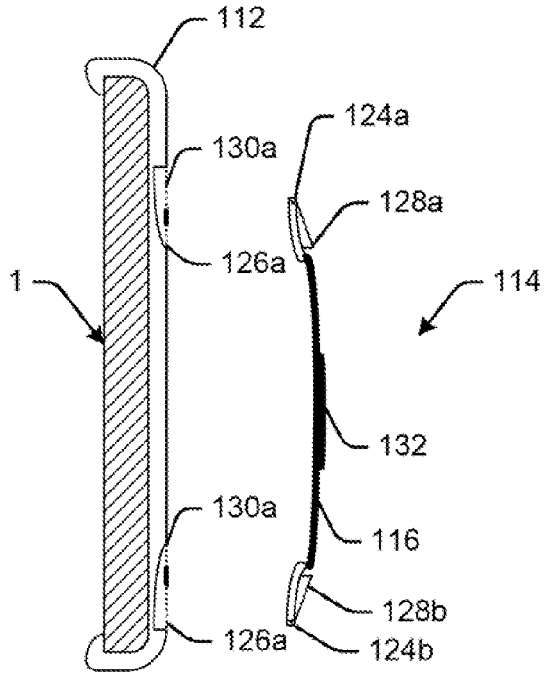
FIG. 3*a* is a cutaway side view of the hand grip attached to the handheld electronic device taken along lines 3-3 shown in FIG. 3.

FIG. 3 shows an example hand grip 110 as it may be connected to the handheld electronic device 1. FIG. 3*a* is a cutaway side view of the hand grip 110 attached to the handheld electronic device 1 taken along lines 3-3 shown in FIG. 3. 100-series reference numbers refer to like elements and may not be described again.

The hand grip 110 may again include backing 112 removably attachable to a back side of the electronic device 1 by stretching over opposite edge portions of the electronic device 1. The hand grip 110 may also include a handle member 114 connecting with the backing 112. After connecting to the backing 112, the handle member 114 can be grasped with one or more finger of a user to securely hold the electronic device 1 by the user's hand. For example, the user may slide his or her fingers between the electronic device 1 and the handle 114.

In the example shown in FIG. 3, the backing 112 may include an engagement mechanism 122*a-b* on each end of the handle member 114. The engagement mechanism 122*a-b* is self-locking during connection of the handle member 114 to the backing 112, for example, by sliding the tab portion 124*a-b* into the respective slots 126*a-b* formed in the backing 112. The button portion 128*a-b* of the engagement mechanism 122*a-b* depress and then are biased outward into opening 130*a-b* to lock onto the backing 112. The engagement mechanism 122*a-b* may be manually depressed and pulled out of the slot 126*a-b* to unlock the handle member 114 from the backing 112.

Also shown in the example of FIG. 3 is an adjustment member 132 for the handle member 114. The adjustment member 132 may be a buckle or other suitable device that enables the strap 116 of the handle member 114 to be adjusted for size (e.g., tightened and/or loosened). Logos or other designs may also be provided on the adjustment member 132. Strap 116 and hand grip 210 may come in different fabrics, styles, designs and colors, etc. In addition, straps for all models may be marketed in packages to suit different occasions (e.g., silicon strap for workouts and leather for work and color for fun).

Figure 4:
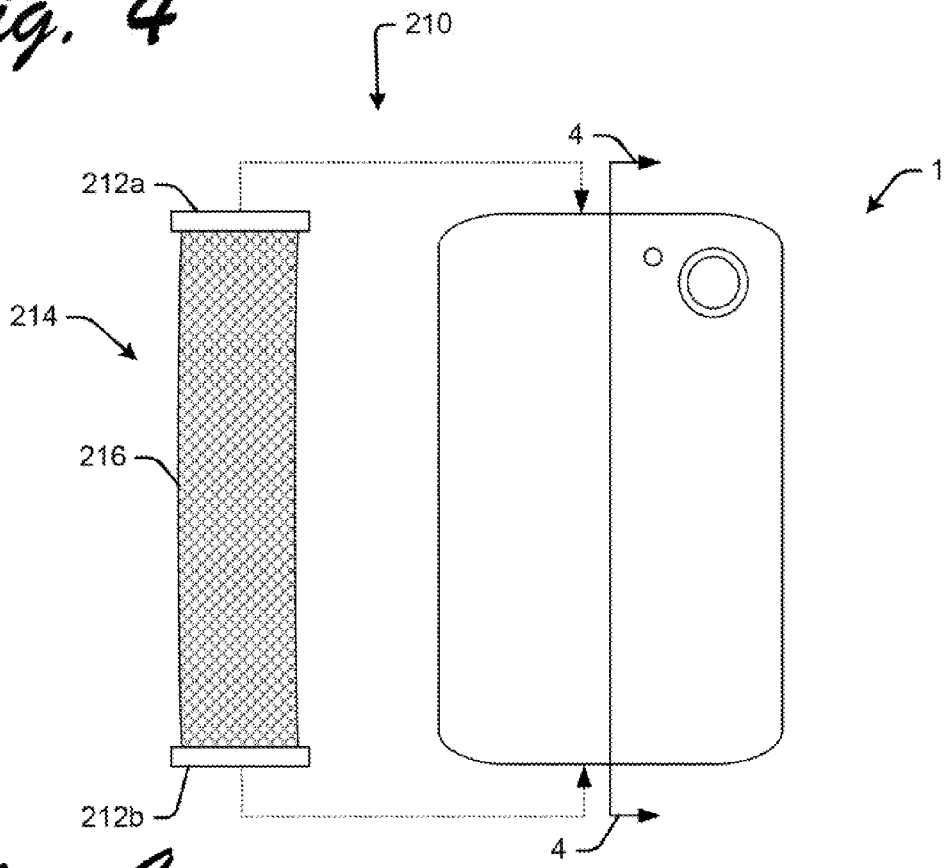
FIG. 4 shows an example hand grip as it may be connected to the handheld electronic device.
Figure 4A:
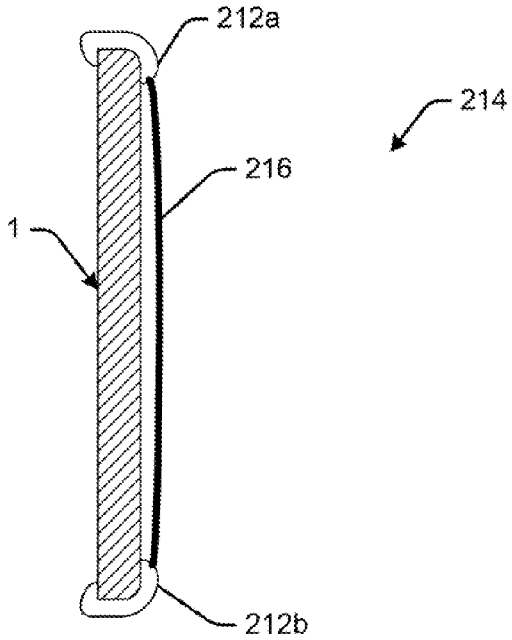
FIG. 4*a* is a cutaway side view of the hand grip attached to the handheld electronic device taken along lines 4-4 shown in FIG. 4.

FIG. 4 shows an example hand grip 210 as it may be connected to the handheld electronic device 1. FIG. 4*a* is a cutaway side view of the hand grip 210 attached to the handheld electronic device 1 taken along lines 4-4 shown in FIG. 4. 200-series reference numbers refer to like elements and may not be described again.

The hand grip 210 may again include backing removably attachable to a back side of the electronic device 1 by stretching over opposite edge portions of the electronic device 1. But in the example shown in FIG. 4, the backing does not cover the entire electronic device 1. Instead, the backing is configured as clip members 212*a-b* that attach on the top and bottom (or opposite sides) of the electronic device 1. A tightening component may also be provided, e.g., as shown in FIG. 3.

Again, the hand grip 210 may include a handle member 214 connecting with the backing 212. After connecting to the backing 212, the handle member 214 can be grasped with one or more finger of a user to securely hold the electronic device 1 by the user's hand. For example, the user may slide his or her fingers between the backing 212 on the electronic device 1 and the handle 214.

Figure 5:
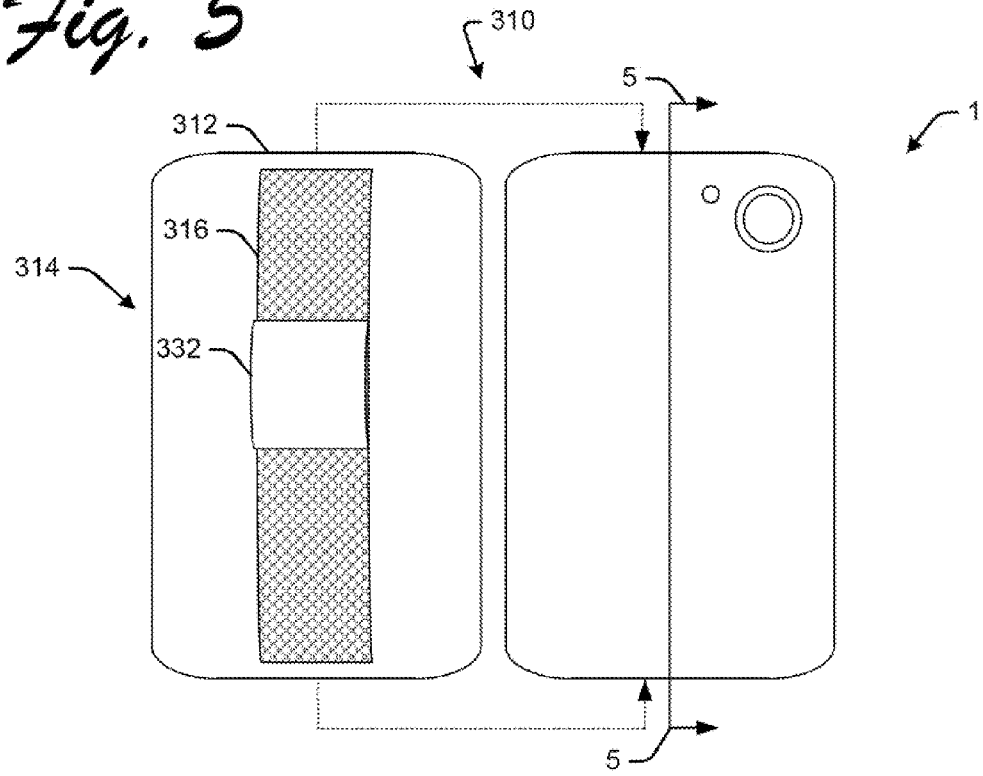
FIG. 5 shows an example hand grip as it may be connected to the handheld electronic device.

FIG. 5 shows an example hand grip 310 as it may be connected to the handheld electronic device 1. 300-series reference numbers refer to like elements and may not be described again.

The hand grip 310 may again include backing 312 removably attachable to a back side of the electronic device 1 by stretching over opposite edge portions of the electronic device 1. The hand grip 310 may also include a handle member 314 connecting with the backing 312. But in the example shown in FIG. 5, the handle member 314 is permanently or semi-permanently attached to the backing 312.

Figure 5A:
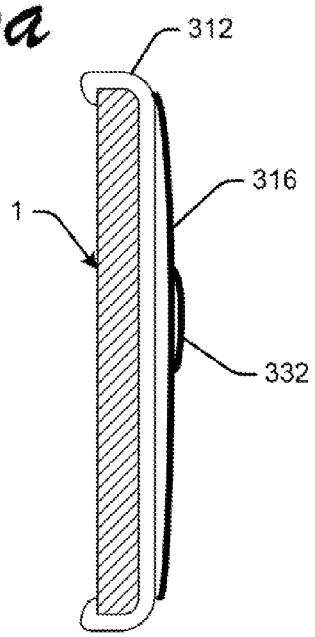
FIG. 5*a* is a cutaway side view of the hand grip attached to the handheld electronic device taken along lines 5-5 shown in FIG. 5.

FIG. 5*a* is a cutaway side view of the hand grip 310 attached to the handheld electronic device 1 taken along lines 5-5 shown in FIG. 5. In this example, the handle member 316 is attached by fusing or other permanent or semi-permanent means to the backing 312.

Figure 5B:
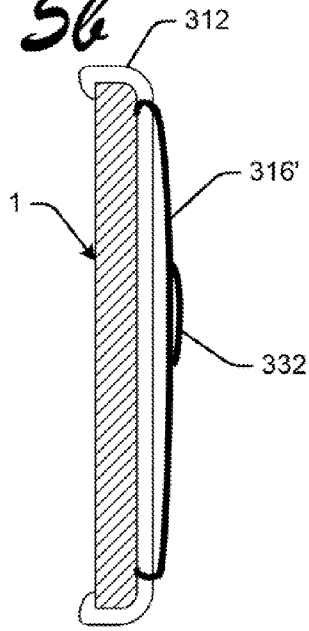
FIG. 5*b* is a cutaway side view of another hand grip attached to the electronic device taken along lines 5-5 shown in FIG. 5.

FIG. 5*b* is a cutaway side view of another hand grip 310 attached to the electronic device 1 taken along lines 5-5 shown in FIG. 5. In this example, the handle member 316' is attached through an opening or slot formed through the backing 312.

After connecting to the backing 312, the handle member 316' can be grasped with one or more finger of a user to securely hold the electronic device 1 by the user's hand. For example, the user may slide his or her fingers between the backing 312 on the electronic device 1 and the handle 316'.

Figure 6:
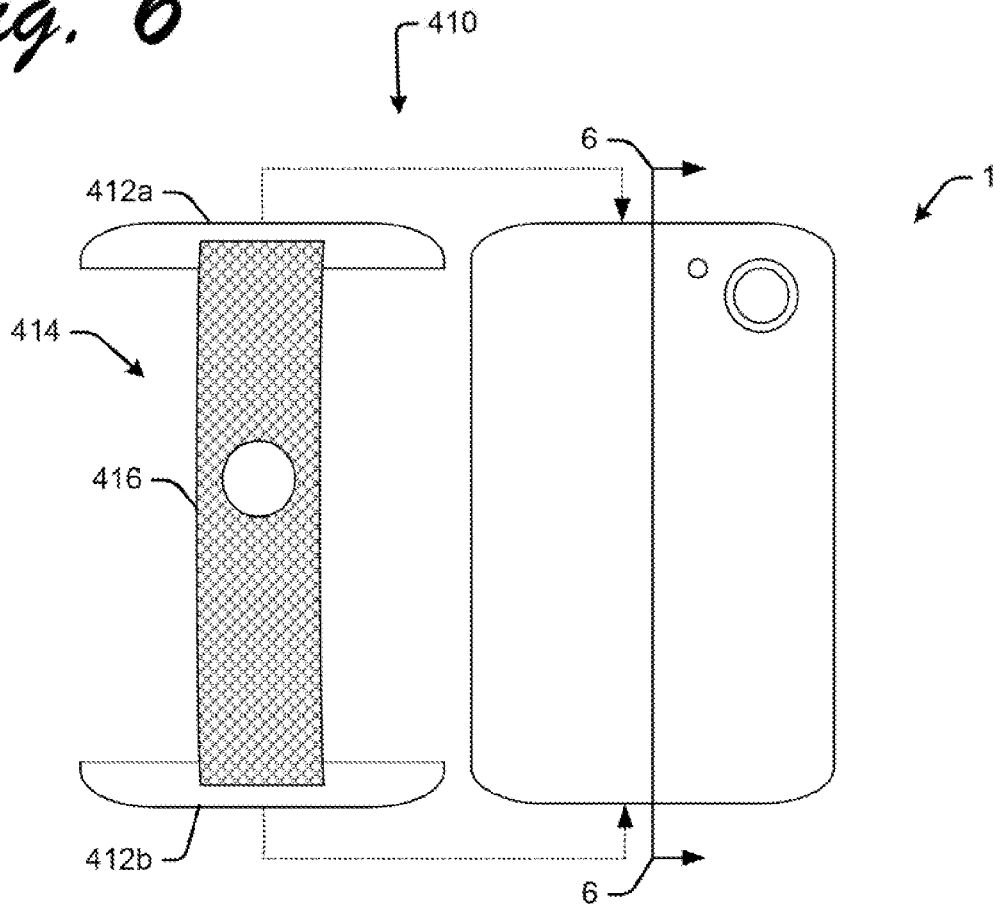
FIG. 6 shows an example hand grip as it may be connected to the handheld electronic device.
Figure 6A:
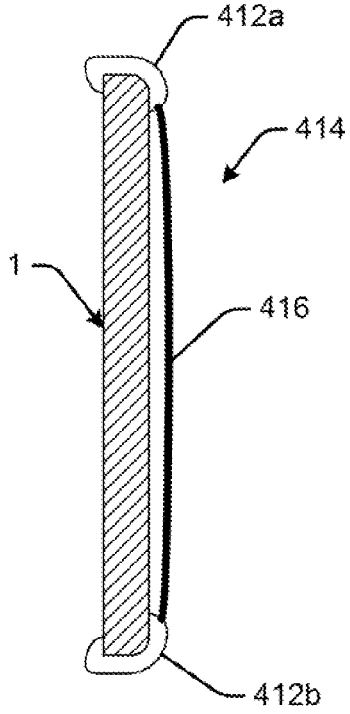
FIG. 6*a* is a cutaway side view of the hand grip attached to the handheld electronic device taken along lines 6-6 shown in FIG. 6.

FIG. 6 shows an example hand grip 410 as it may be connected to the handheld electronic device 1. FIG. 6*a* is a cutaway side view of the hand grip 410 attached to the handheld electronic device 1 taken along lines 6-6 shown in FIG. 6. 400-series reference numbers refer to like elements and may not be described again.

The hand grip 410 may again include backing 412 removably attachable to a back side of the electronic device 1 by stretching over opposite edge portions of the electronic device 1. The hand grip 410 may also include a handle member 414 connecting with the backing 412. But in the example shown in FIG. 6, the backing 412 includes clip members or socks or end caps 412*a-b* that fit over the edge of the handheld electronic device 1, similar to those described above for FIG. 4.

Figure 7A:
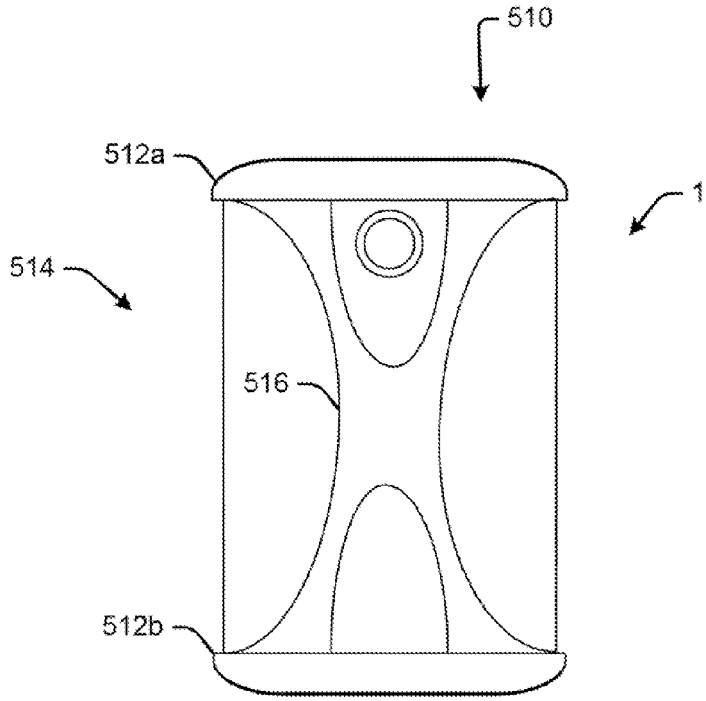
FIG. 7*a* is a back plan view of an example hand grip as it may be connected to the handheld electronic device.

FIG. 7*a* is a back plan view of an example hand grip 510 as it may be connected to the handheld electronic device 1. 500-series reference numbers refer to like elements and may not be described again. In this example, the hand grip 510 includes backing formed as clips or covers/caps/socks 512*a-b* with an elastic strap 516 formed therebetween. The elastic strap 516 has a substantially "X" shape and can be designed to fit around various positions of the camera lens.

Figure 7B:
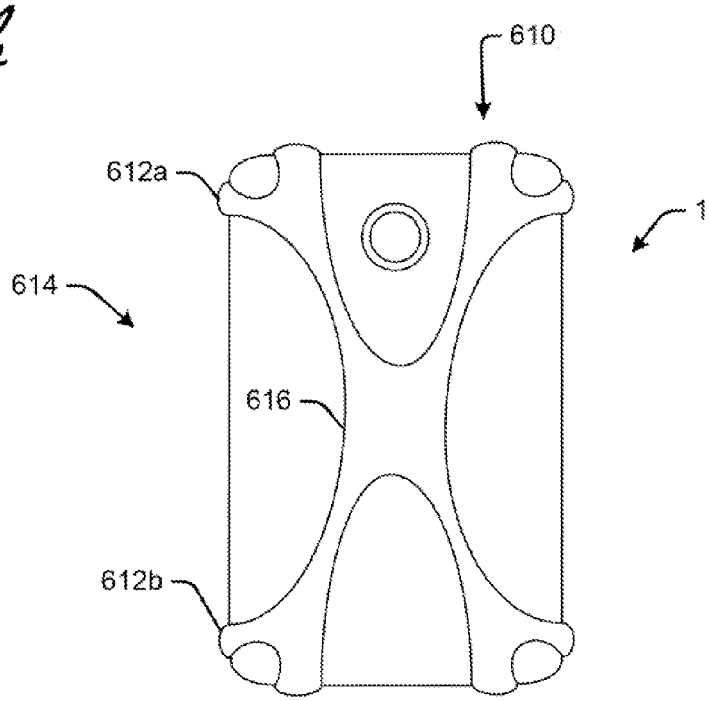
FIG. 7*b* is a back plan view of another example hand grip as it may be connected to the handheld electronic device.

FIG. 7*b* is a back plan view of another example hand grip 610 as it may be connected to the handheld electronic device 1. 600-series reference numbers refer to like elements and may not be described again. In this example, the handle member connects to each of four corners of the electronic device 1, and the handle member forms an integral part of the backing itself, providing a protection mechanism if the phone is dropped.

Figure 8:
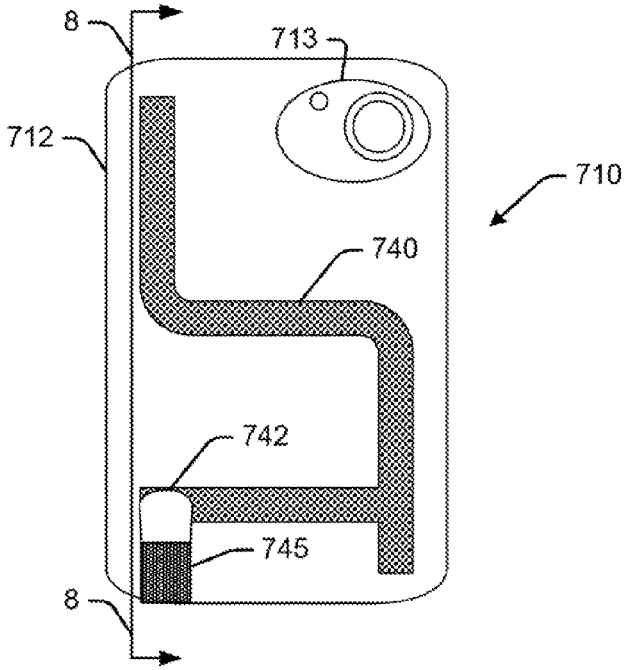
FIG. 8 is a back plan view of an example hand grip as it may be connected to the handheld electronic device.
Figure 8A:
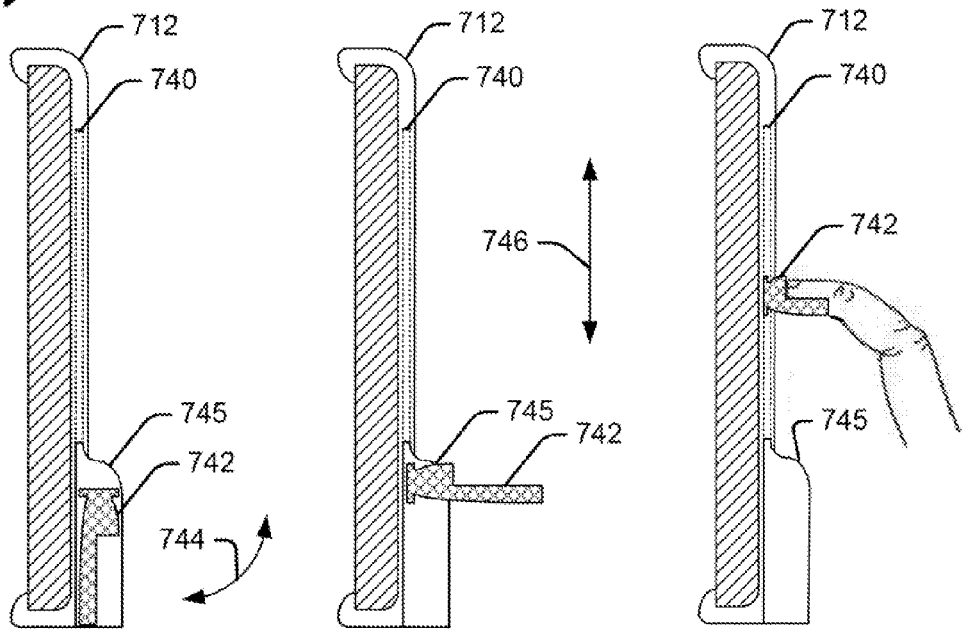
FIG. 8*a* are cutaway side views illustrating the hand grip as it may be connected to the handheld electronic device and moved in a track formed in the backing of the hand grip, taken along lines 8-8 shown in FIG. 8.

FIG. 8 is a back plan view of an example hand grip 710 as it may be connected to the handheld electronic device 1. FIG. 8*a* shows cutaway side views illustrating the hand grip 710 as it may be connected to the handheld electronic device 1 and moved in a track 740 formed in the backing 712 of the hand grip 710, taken along lines 8-8 shown in FIG. 8.

In this example, a finger cup 742 slides in the track 740 formed within the backing 712. The track 740 may have any desired design. In FIG. 8, the track 740 is shown as it may cross to at least three corners of the backing 712. The finger cup 742 may be housed in a collapsed position in a pocket 745 (best seen in the side views of FIG. 8*a*). The pocket 745 may be formed by a raised portion in some or all of the backing 712.

The finger cup 742 may be form-fitting (e.g., made of a pliable or soft silicon) to at least partially conform around a tip portion of the finger of the user. Although the end portion that fits inside the track 740 may be made of a harder plastic or metal to slide more readily within the track 740 and reduce the occurrence of breaking.

The finger cup 742 can be readily grasped by a user by inserting his or her finger (e.g., an index finger). The finger cup 742 lays substantially flat against the back side of the electronic device in a collapsed position. The finger cup 742 may be provided in a container area 745 in the backing 712.

In use, the finger cup 742 is movable (e.g., between about 45 and 90 degrees) between the collapsed position and an operating position, as illustrated by arrow 744 between the first and the second drawing in FIG. 8*a*. It is noted that because part of the cup 742 is form fitting and pliable, the finger can bend somewhat away from this range (e.g., beyond 90 degrees). The finger cup 742 can then slide around in the track 740, as illustrated by arrow 746 between the second and the third drawing in FIG. 8*a*.

Figure 8B:
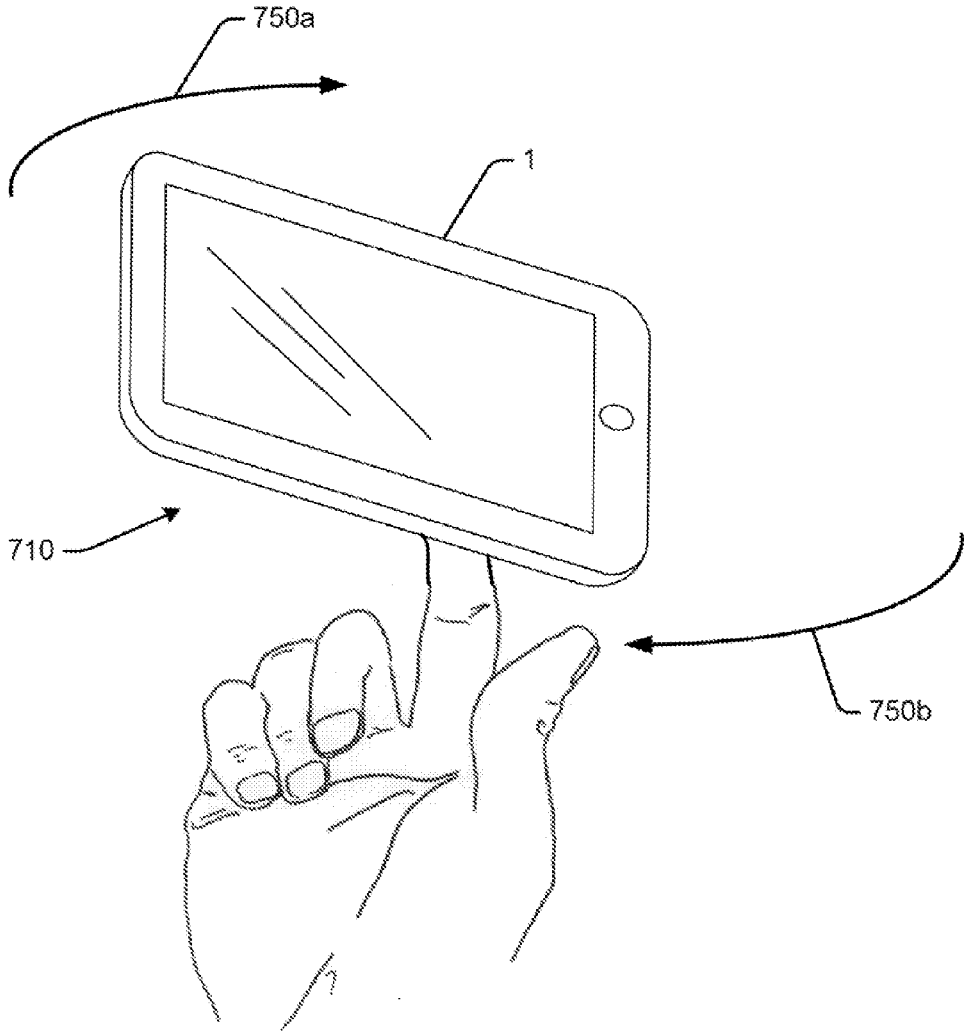
FIG. 8*b* is a perspective illustration showing how a user can hold and move the electronic device using the hand grip shown in FIGS. 8 and 8*a*.

FIG. 8*b* is a perspective illustration showing how a user can hold and move the electronic device 1 using the hand grip shown 710 in FIGS. 8 and 8*a*. The finger cup 742 (not visible in FIG. 8*b*) rotates 360 degrees within the track 740 thus allowing unlimited degrees of freedom, as illustrated by arrows 750*a-b*.

It is noted that the examples shown and described are provided for purposes of illustration and are not intended to be limiting. Still other examples are also contemplated.

The invention claimed is:

1. A hand grip for an electronic device, comprising:

a backing removably attachable to a back side of the electronic device by stretching over opposite edge portions of the electronic device:

a handle member connecting with the backing, the handle member connecting with one or more finger of a user to securely hold the electronic device by the hand of the user allowing for phone manipulations with only one hand;

an engagement mechanism on each end of the handle member, the engagement mechanism slidable into the backing to automatically self-lock the handle member to the backing, wherein the handle member unlocks from the backing upon manual depression of the engagement mechanism;

wherein the engagement mechanism includes a tab configured for slideable engagement with a slot provided in the backing;

wherein a button of the engagement mechanism is biased outwardly while the handle is locked to the backing; and wherein the backing further comprises an opening configured to receive the outwardly biased button of the engagement mechanism.

2. The hand grip of claim 1, wherein the handle member is resilient to lay substantially flat against the back side of the electronic device when not in use.

3. The hand grip of claim 1, further comprising:

an elongated notch formed inside opposite end portions of the backing; and an insert on each end of the handle member, the insert engaging inside the elongated notch to attach the handle member to the backing.

4. The hand grip of claim 1, wherein the handle member is adjustable.

5. A hand grip for an electronic device, comprising:

means for attaching to a back side of the electronic device, the means for attaching being both stretchable and removable;

means for gripping by one or more finger of a user to securely hold the electronic device when the means for attaching is attached to the electronic device;

means for locking the means for gripping to the means for attaching during sliding connection of the means for gripping to the means for attaching, wherein the means for gripping unlocks from the means for attaching upon manual depression of the means for locking; and wherein the means for locking includes a means for slideably engaging with a slot provided in the means for attaching.

* * * * *